US008714241B2

(12) United States Patent
Joseph et al.

(10) Patent No.: US 8,714,241 B2
(45) Date of Patent: May 6, 2014

(54) APPARATUS AND METHOD FOR SEALING PORTIONS OF A WELLBORE

(75) Inventors: Basil J. Joseph, Sugar Land, TX (US); Michael Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 407 days.

(21) Appl. No.: 12/764,453

(22) Filed: Apr. 21, 2010

(65) Prior Publication Data

US 2011/0259587 A1 Oct. 27, 2011

(51) Int. Cl.
*E21B 33/12* (2006.01)

(52) U.S. Cl.
USPC ..... 166/179; 166/387

(58) Field of Classification Search
USPC ..... 166/387, 179, 180, 191
See application file for complete search history.

(56) References Cited

U.S. PATENT DOCUMENTS

| | | | | |
|---|---|---|---|---|
| 6,053,992 | A | 4/2000 | Wu et al. | |
| 6,840,257 | B2 | 1/2005 | Dario et al. | |
| 2005/0067170 | A1 * | 3/2005 | Richard | 166/387 |
| 2008/0087431 | A1 * | 4/2008 | Willauer et al. | 166/290 |
| 2008/0149323 | A1 * | 6/2008 | O'Malley et al. | 166/53 |
| 2008/0264647 | A1 | 10/2008 | Li | |
| 2009/0084539 | A1 | 4/2009 | Duan et al. | |
| 2009/0101354 | A1 | 4/2009 | Holmes et al. | |
| 2010/0089565 | A1 | 4/2010 | Duan et al. | |

OTHER PUBLICATIONS

Notification of Transmittal of the International Search Report and the Written Opinion of the International Searching Authority, or the Declaration; PCT/US2011/032256. Sep. 27, 2011.

Bhavsar, Rashmi et al. "Intelligence in Novel Materials," Oilfield Review Spring 2008. pp. 32-41.

Bogue, Robert. "Shape-Memory Materials: A Review of Technology and Applications" (Abstract Only), Assembly Automation Journal, vol. 29 No. 3, 2009, pp. 214-219.

* cited by examiner

*Primary Examiner* — William P Neuder
*Assistant Examiner* — Taras P Bemko
(74) *Attorney, Agent, or Firm* — Cantor Colburn LLP

(57) ABSTRACT

An apparatus for controlling fluid flow in a borehole in an earth formation includes a carrier configured to be deployed in the borehole and a shape memory device disposed at the carrier that includes a shape memory material having a glass transition temperature. The shape memory material is configured to modify the glass transition temperature to a temperature lower than a borehole temperature in response to a trigger, and change from a glass state to a rubber state in response to the borehole temperature to prevent fluid flowing through the shape memory device.

18 Claims, 12 Drawing Sheets

APPARATUS AND METHOD FOR SEALING PORTIONS OF A WELLBORE

BACKGROUND

In the drilling and completion industry and for example in hydrocarbon exploration and recovery operations, efforts to improve production efficiency and increase output are ongoing. Some such efforts include preventing undesired fluids or other materials from entering a production borehole. Such materials can pose problems by reducing production efficiency and increasing production costs, for example.

Downhole packer systems can be employed in an attempt to prevent entry of unwanted materials into a production flow. Such systems can be difficult to employ and utilize in a manner that is responsive to changes in composition of fluid being extracted from an earth formation.

SUMMARY

An apparatus for controlling fluid flow in a borehole in an earth formation includes: a carrier configured to be deployed in the borehole; and a shape memory device disposed at the carrier, the shape memory device including a shape memory material having a glass transition temperature, the shape memory material configured to modify the glass transition temperature to a temperature lower than a borehole temperature in response to a trigger, and change from a glass state to a rubber state in response to the borehole temperature to prevent fluid flowing through the shape memory device.

A method of controlling fluid flow in a borehole in an earth formation includes: deploying a fluid flow apparatus in the borehole, the apparatus including a carrier and a shape memory device disposed at the carrier, the shape memory device including a shape memory material having a glass transition temperature; modifying the glass transition temperature to a temperature lower than a borehole temperature in response to a trigger; and changing the shape memory material from a glass state to a rubber state in response to the borehole temperature to prevent fluid flowing through the shape memory device.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
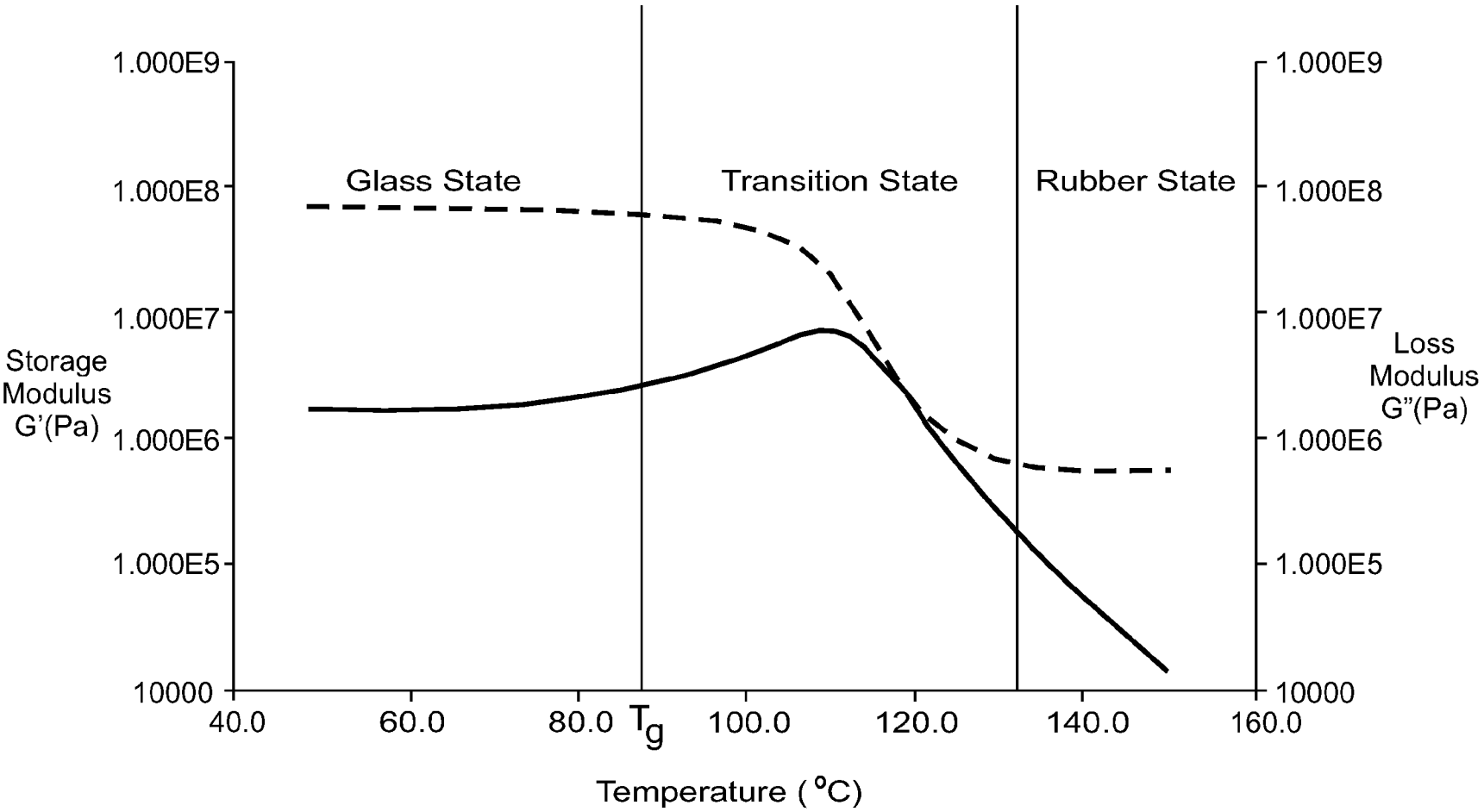
FIG. 1 is a plot showing a transition of a shape memory material from a glass state to a rubber state.

The apparatuses, systems and methods described herein provide for controlling the flow of fluid in a borehole in an earth formation. A fluid flow control apparatus includes a shape memory material that is configured to seal off a portion of a borehole or borehole component due to a change in the material's glass transition temperature in response to a trigger. The trigger may cause the transition temperature to lower to a point below a borehole temperature, and as a result, the shape memory material may change to a rubber state from a glass state. As a result of this transition, the shape memory material changes shape and/or pores within the material collapse to prevent fluid flowing therethrough and to seal off a selected portion of a borehole and/or borehole component. In one embodiment, this change in state causes the shape memory material to revert from a deformed shape into a remembered shape (such as a packer or plug shape) to seal off at least a portion of the borehole and prevent the passage of an undesired fluid therethrough. In one embodiment, the shape memory material is a porous material including a plurality of pores that collapse due to the change in state to prevent fluid from flowing therethrough. In one embodiment, the trigger includes the introduction of an undesired fluid (such as water or hydrogen sulphide ($H_2S$) gas) in the borehole. The trigger may also include a change of the chemistry of the downhole fluid or a magnetic or electro-conductive trigger. The apparatus can be configured as one or more packers or other devices included to seal off one or more selected portions of the borehole.

Shape memory materials include materials such as Shape Memory Polymers (SMP) that have the ability to return from a deformed state (a temporary shape, also referred to herein as a "deployment shape") to their original shape prior to deformation (referred to herein as a "remembered shape" or "activated shape") in response to a stimulus such as a temperature change, an electric or magnetic field, electromagnetic radiation, and a change in pH. Non-limiting examples of shape memory materials include Shape Memory Polymers (SMP), such as polyurethane or epoxy SMPs, which may have properties ranging from, for example, stable to biodegradable, soft to hard, and elastic to rigid, depending on the structural units that constitute the SMP. SMPs may also include thermoplastic and thermoset (covalently cross-linked) polymeric materials. SMPs may also be able to store multiple shapes in memory. Examples of SMPs include polyurethane, polyurethane foams, epoxies, polycarbonate-polyurethane, polycarbonate-polyureas, polyethylene oxide/Polyethylene terephthalate copolymers crosslinked with glycerol/dimethyl 5-sulfoisopthalate or maleic anhydride, polyethylene oxide/acrylic acid/methacrylic acid copolymer crosslinked with N,N'-methylene-bis-acrylamide, polyethylene oxide/methacrylic acid/N-vinyl-2-pyrrolidone copolymer crosslinked with ethyleneglycol dimethacrylate, polyethylene oxide/Poly (methyl methacrylate)/N-vinyl-2-pyrrolidone copolymer crosslinked with ethyleneglycol dimethacrylate. Other materials may be formed from polyamides, polyvinyl alcohols, vinyl alcohol-vinyl ester copolymers, phenolic polymers, and polybenzimidazoles.

FIG. 1 illustrates viscoelastic properties of a SMP, including the storage modulus $\epsilon'$ (elastic response) and loss modulus $\epsilon''$ (viscous response) of a polymer as a function of temperature. The storage modulus is related to stiffness, and the loss modulus to damping and energy dissipation. The SMP properties and shape memory activation described in reference to FIG. 1 are in response to temperature changes, although other activation methods including application of electric or magnetic field, application of light or other electromagnetic radiation, a chemical change such as a change in pH or exposure to certain chemical compositions are contemplated. The nature of the transition phase is descriptive of the polymer's shape memory behavior during shape recovery. The glass state of the SMP is depicted as a change in storage modulus in response to change in temperature that yields a line of constant slope. A transition state begins when a slope change occurs in the storage modulus as the temperature is increased. The onset of the transition state is referred to as the transition temperature (Tg) onset which in FIG. 1 is approximately 90° C. The Tg onset is also the point where shape recovery can begin. The glass transition temperature (Tg) for the SMP described by FIG. 1 is defined as the peak of the loss modulus, which in FIG. 1 is approximately 110° C. The glass transition temperature may range from below room temperature to an extremely elevated temperature. The selection of an appropriate glass transition temperature may depend on application temperatures, such as those found during downhole applications, and the effectiveness of a particular activation means in altering the glass transition temperature change.

In one embodiment, the shape memory polymer is manufactured having a selected isocyanate-polyol ratio, which affect the glass transition temperature. In one embodiment, by adjusting the stoichiometric ratio of isocyanate to polyol during molding of an SMP component, the resulting component can have variable Tg's and Tg Onsets at various points within the finished component.

Referring to FIGS. 2-11, an exemplary embodiment of a subterranean well drilling, evaluation, exploration and/or production system 10 includes a borehole string 12 that is shown disposed in a borehole 14 that penetrates at least one earth formation 16 during a subterranean operation. As described herein, a "formation" refers to the various features and materials that may be encountered in a subsurface environment and surround the borehole 14. The borehole 14 may be an open borehole or a cased borehole. In one embodiment, the system 10 is a hydrocarbon production system and the borehole string 12 is a production string. A fluid flow control apparatus 18 includes a shape memory material device 20 made from a shape memory material 22 and disposed at the borehole string 12 or other carrier. The shape memory material has a first transition temperature that changes into a second lower transition temperature in response to the trigger. In one embodiment, the shape memory material is configured to change from a deformed or "deployment shape" into a packer, plug or other shape configured to prevent fluid flow into a portion of a borehole as a result of the trigger. In one embodiment, the shape memory material is a cellular or porous material such as a compressible foam having pores such as bubbles, cells or other porous structures therein that collapse as a result of the trigger to prevent fluid flow therethrough. The system may include one or more shape memory material devices that can be activated to form similar or different shapes. In addition, the shape memory devices can be configured to change to different transition temperatures upon activation to accommodate different downhole temperatures or other conditions. For example, the transition temperature may include any range of transition temperatures from room temperature or below to borehole temperatures (e.g., about 100° Fahrenheit (F.)-about 250° F.) and above.

Figure 2:
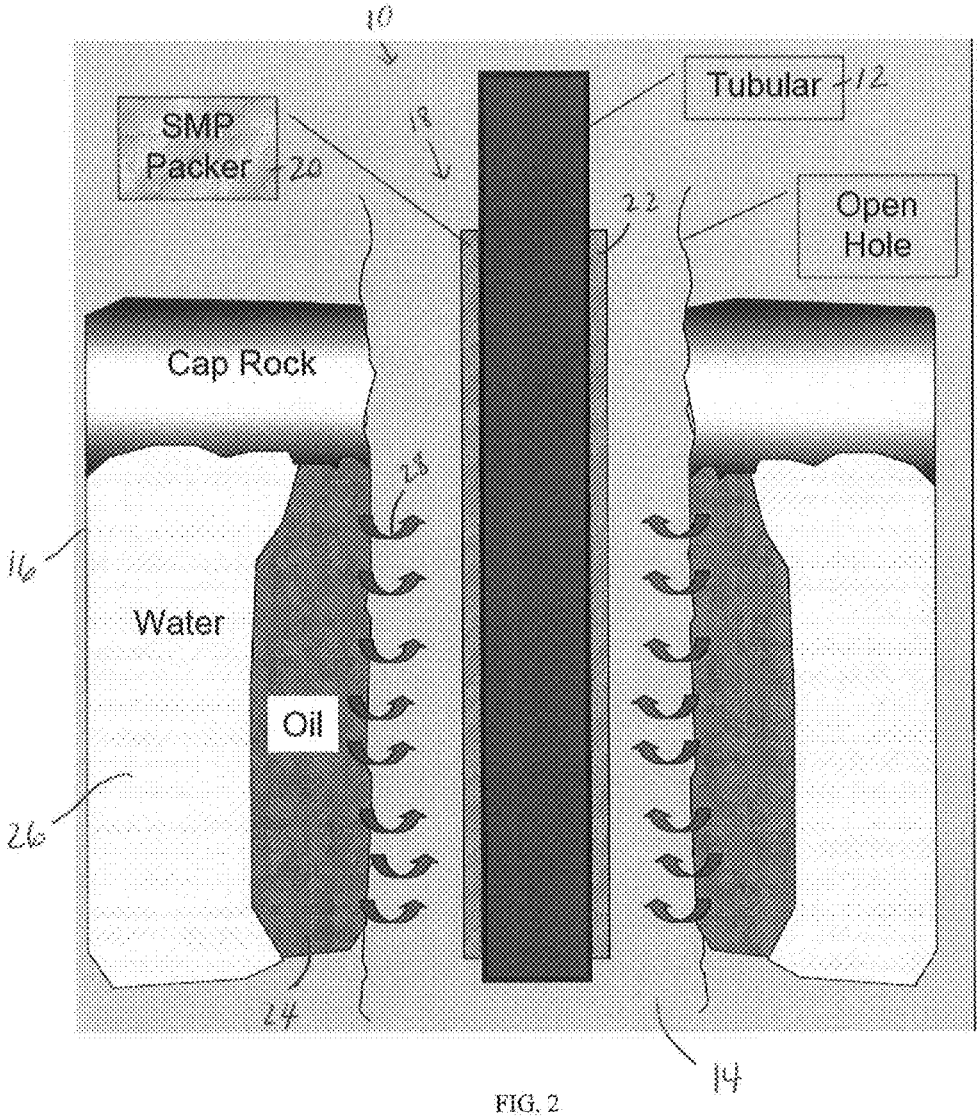
FIG. 2 is a cross-sectional view of an embodiment of a fluid flow control system.
Figure 3:
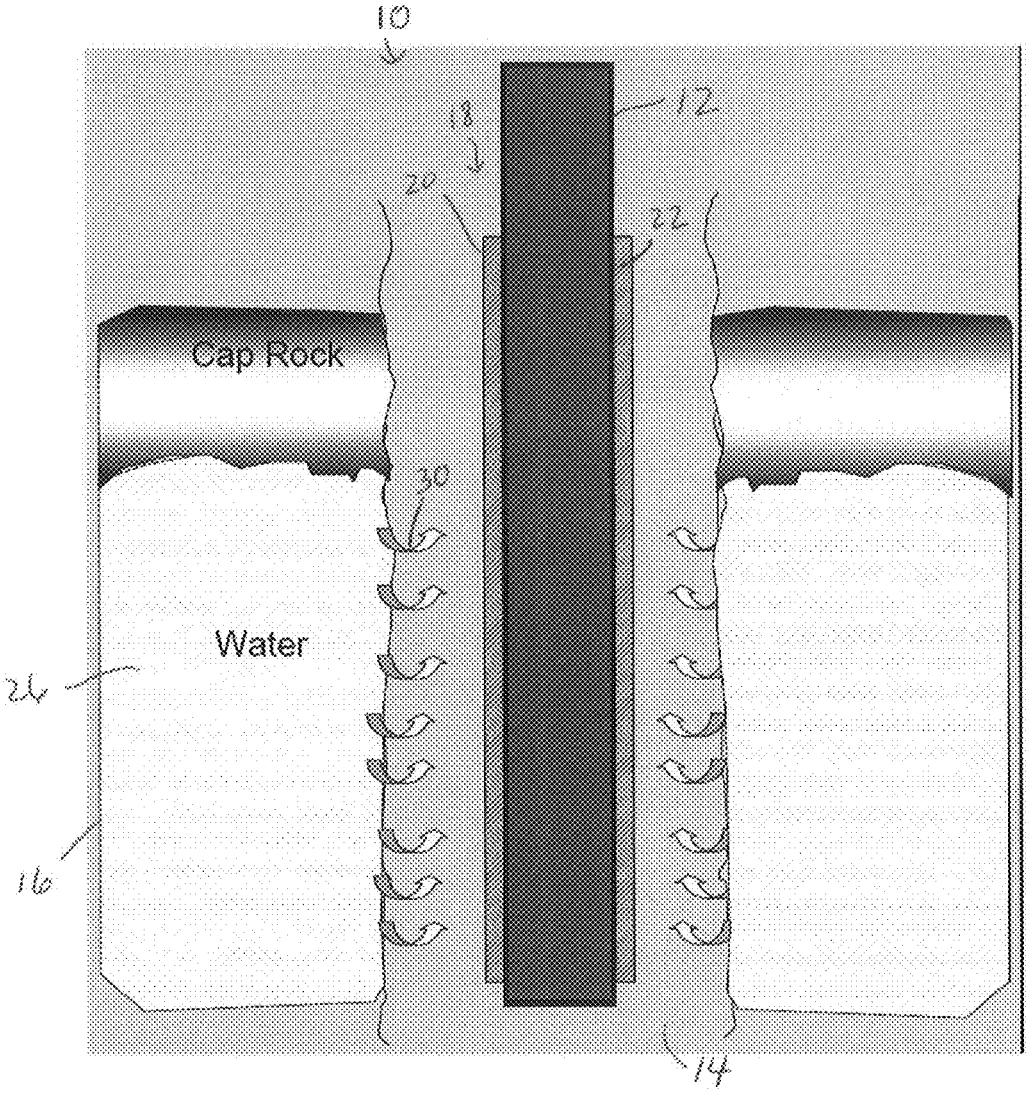
FIG. 3 is a cross-sectional view of the fluid flow control system of FIG. 2.
Figure 4:
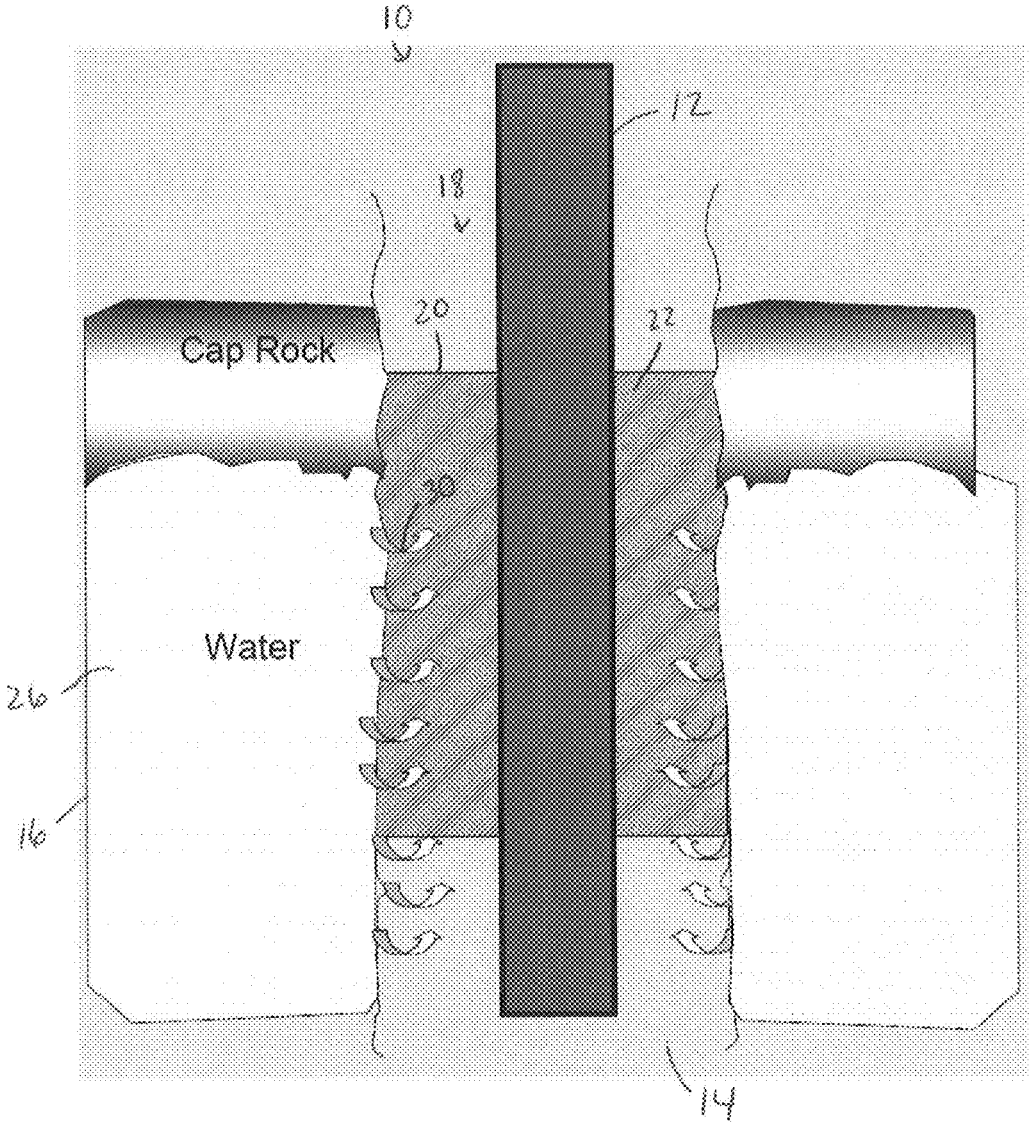
FIG. 4 is a cross-sectional view of the fluid flow control system of FIG. 2 after activation of at least one shape memory material.

FIGS. 2-4 illustrates an embodiment of the fluid flow control apparatus 18 configured to be deployed in the borehole 14. The borehole 14, in this embodiment, is located in a region of the formation 16 that includes a hydrocarbon region 24, which is at least partially composed of a hydrocarbon such as oil or natural gas, and a water region 26, which is primarily composed of a non-hydrocarbon fluid such as water or $H_2S$. In this embodiment, the shape memory device 20 is disposed on an exterior surface of the borehole string 12 and is configured to expand into a packer shape due to a trigger. The water region is not limited to the constituents described herein, and may include any undesired fluid. Examples of such undesired fluids include fluids introduced or otherwise present in production fluid or a production stream, such as non-hydrocarbon fluids or gases including water, carbon dioxide and $H_2S$, and undesired hydrocarbon fluids including hydrocarbon gases (e.g., natural gas).

At an instance shown in FIG. 2, hydrocarbons 28 are being produced through the annulus between the borehole string 12 and the formation 16 as part of the production fluid. As described herein, "production fluid" refers to hydrocarbons, water and any other substances in fluid form that may be produced from an earth formation or introduced in the borehole from the surface. The shape memory material 22, which in this embodiment is a SMP 22, has a first transition temperature that is higher than a temperature of the borehole 14 and has a condensed deployment shape that defines a diameter that is sufficiently less than the borehole diameter to allow the system 10 to be deployed and to allow fluid to flow through the annulus. For example, the SMP 22 is configured as a band wrapped around the borehole string 12. Although in this embodiment the fluid flow is through the annulus and the shape memory device 20 is disposed on an exterior of the borehole string 12, the system 10 may be configured so that fluid flow is in the interior of the borehole string 12 and the shape memory device 20 is disposed within the borehole string 12.

FIG. 3 illustrates an instance where most or all of the hydrocarbons 28 have been produced and water 30 (or a fluid including a substantial amount of water or other undesired fluids) commences to flow through the annulus. In this embodiment, the water 30 has a chemical composition that functions as a trigger to lower the transition temperature and activate the SMP 22. In this embodiment, the SMP 22 is a polyurethane foam or other porous material into which some of the water 30 or other fluids can diffuse.

Referring to FIG. 4, upon exposure of the SMP 22 to the water 30, the transition temperature of the SMP 22 is lowered from the first transition temperature to a second transition temperature that is equal to or lower than the borehole temperature. Because the borehole temperature is now greater than the second transition temperature, the SMP 22 "remembers" its original shape and reverts to the remembered shape. In this embodiment, the remembered shape is the shape of a packer having a diameter that is the same or greater than the borehole diameter. In addition, pores in the SMP 22 collapse when the SMP 22 transitions into the rubber state so that further fluid cannot pass through the SMP 22 and the shape memory device 20. As a result, the shape memory device 20 is now configured as a packer and seals off a selected region of the borehole 14 to prevent water or other undesired fluids from being produced.

Although the trigger is described herein as a change in the production fluid to water, the trigger can be a change in production fluid related to any fluid that is present in the formation fluid. In addition, the trigger may be a chemical, magnetic or electro conductive change in the formation fluid and/or SMP 22. Such triggers may be caused by changes in the formation 16 or changes in the SMP 22 that are activated by a user or remote device.

In one embodiment, the SMP 22 need not be required to change shape in response to the trigger. In one embodiment, the SMP 22 may not be initially deformed or may be constrained in the borehole string 12 and/or the borehole 14 prior to activation. In this embodiment, the shape of the SMP 22 downhole may not change upon activation. However, in this embodiment, the pores in the SMP 22 collapse to seal off the borehole 14.

Figure 5:
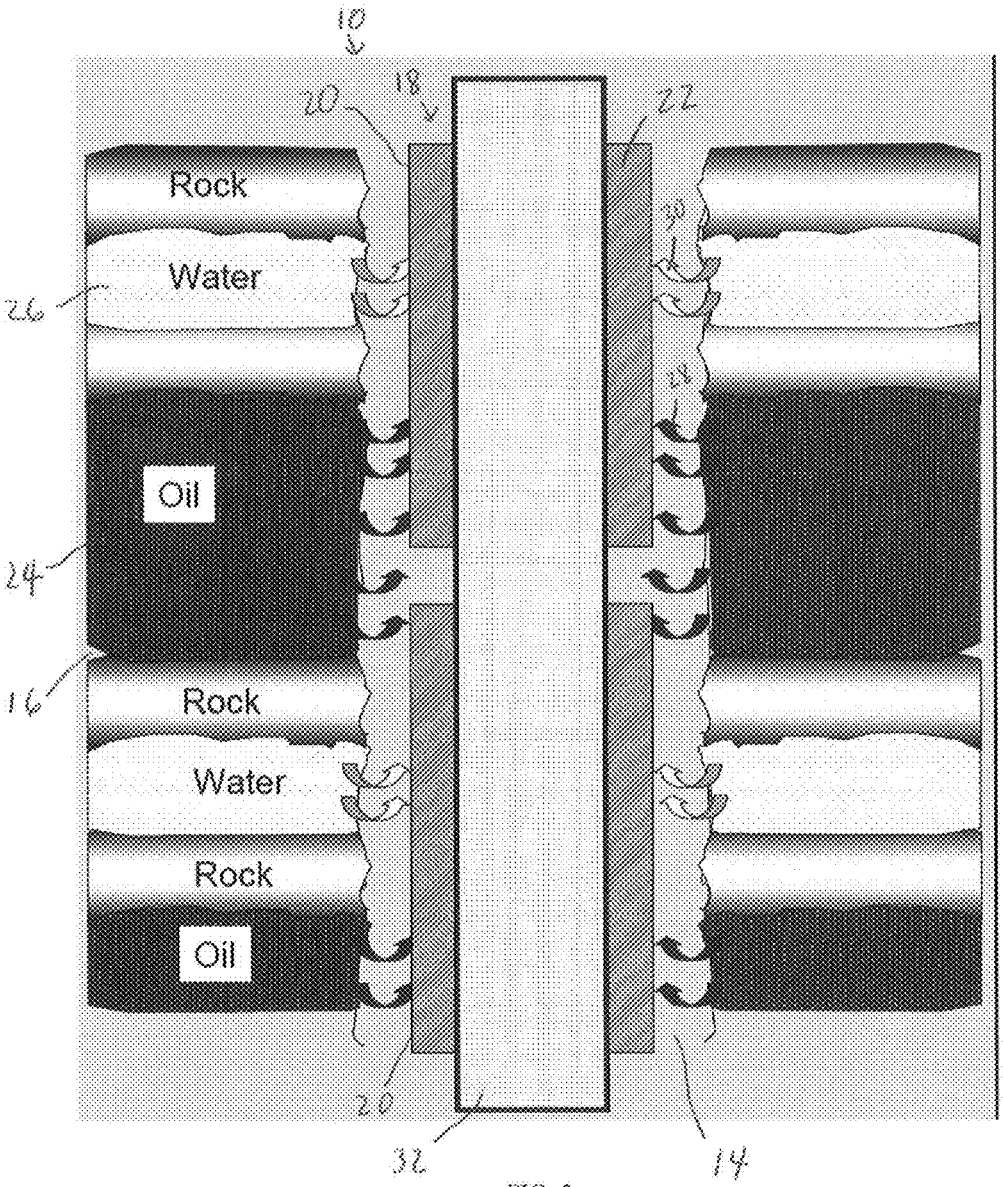
FIG. 5 is a cross-sectional view of an embodiment of a fluid flow control system.
Figure 6:
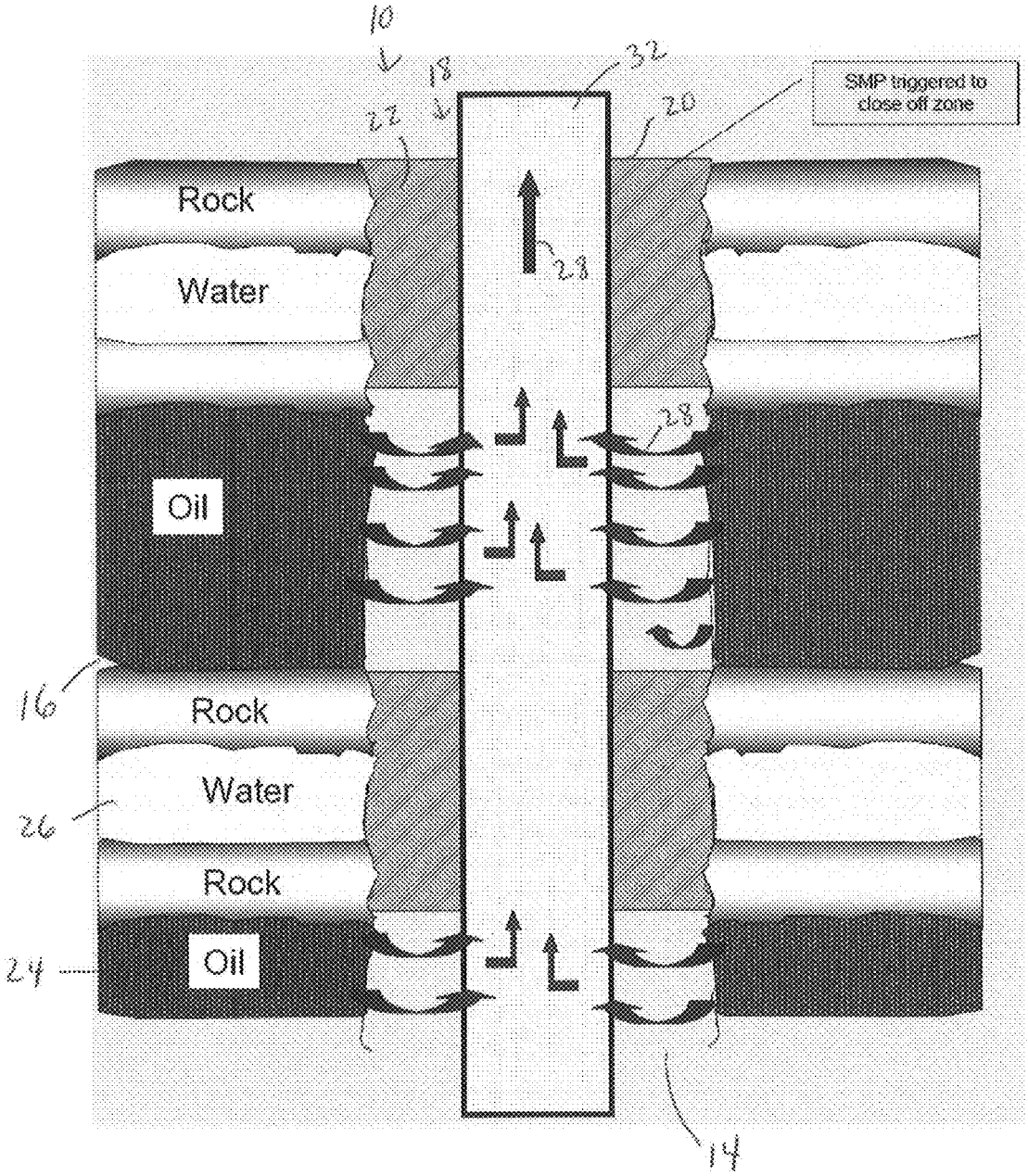
FIG. 6 is a cross-sectional view of the fluid flow control system of FIG. 5 after activation of at least one shape memory material.

FIGS. 5 and 6 illustrate another embodiment of the fluid flow control apparatus 18 configured to be disposed in a formation 16 having multiple production and water zones. The borehole 14 may be a cased or open borehole. In this embodiment, the borehole string 12 is a production string 12 and includes a screen 32 to filter unwanted particulates and other solids, such as sand, from production fluids. In this embodiment, the shape memory material 22 is a porous SMP 22. The apparatus 18 includes a plurality of shape memory devices 20 configured as multiple bands or other shapes wrapped around the production string 12 at multiple locations corresponding to, for example, multiple water regions 26 including water 30 or other undesirable fluids. As undesirable fluids such as water 30 flow into the bands of SMP 22, the bands corresponding to the water zones are exposed to the water 30 and expand and/or collapse to seal off the water regions 26 and prevent water from flowing into the screen 28.

Figure 7:
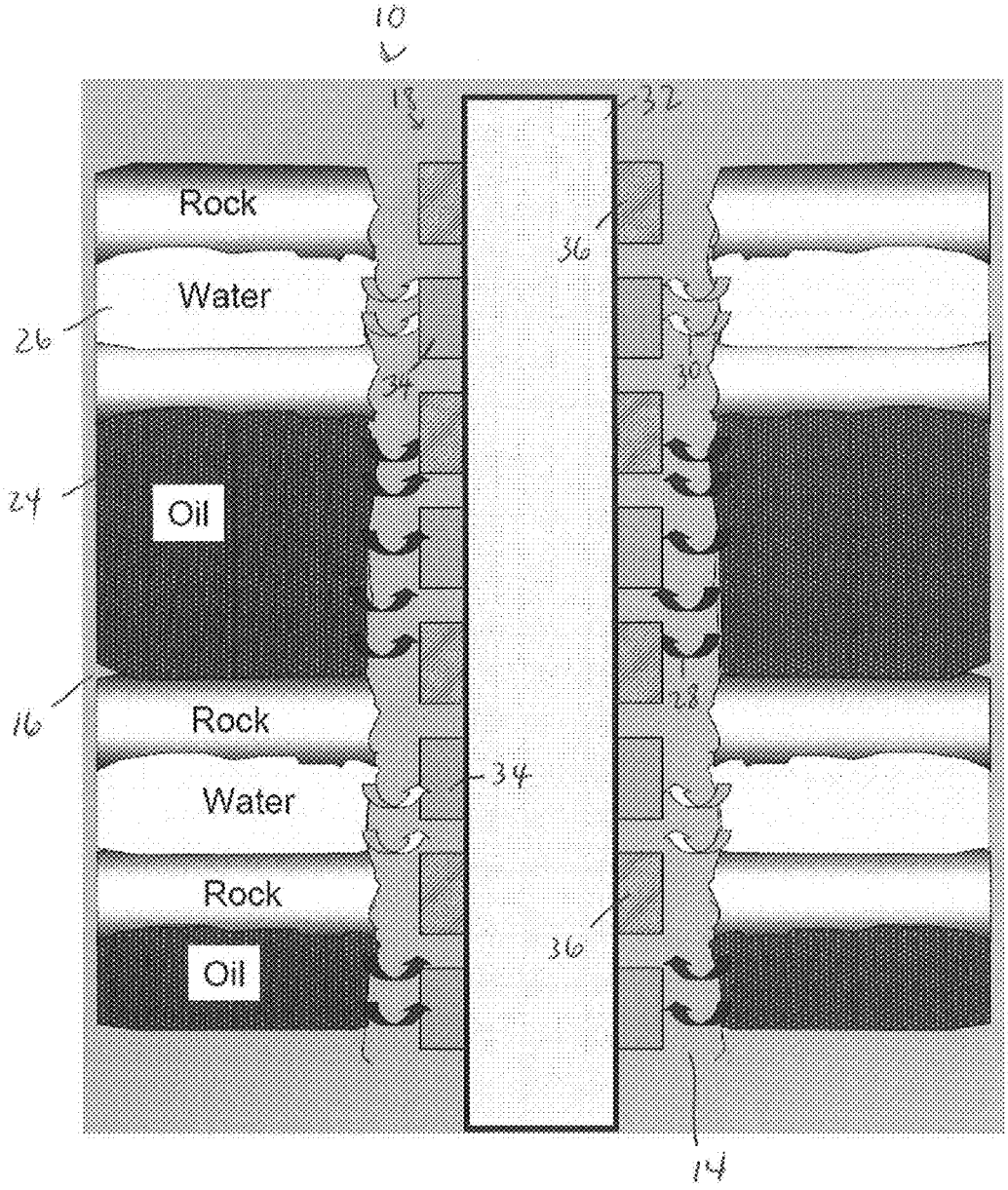
FIG. 7 is a cross-sectional view of an embodiment of a fluid flow control system.
Figure 8:
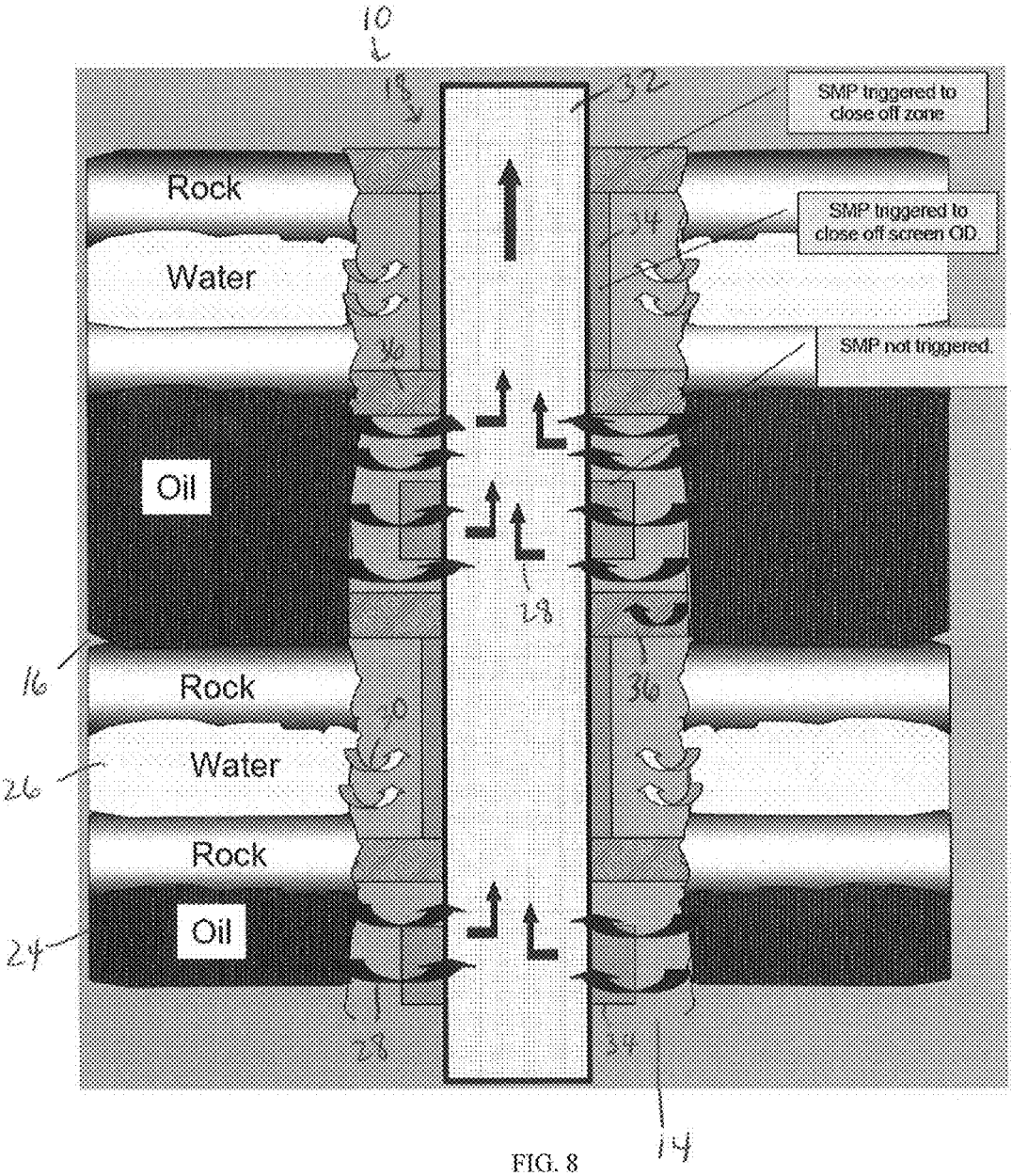
FIG. 8 is a cross-sectional view of the fluid flow control system of FIG. 7 after activation of at least one shape memory material.

Referring to FIGS. 7 and 8, multiple shape memory devices 20 may be disposed in the borehole 14 and configured to form different shapes upon activation. As shown in FIG. 7, in one embodiment, the apparatus 18 includes multiple shape memory devices 20 that can be deployed to seal off regions of the annulus as well as regions of the screen 32. For example, the shape memory devices 20 includes screen sealing devices 34 and annulus packer devices 36 disposed on the screen 32 and having deployment shapes that are small enough so that production fluid can flow around the devices 34, 36 and through the screen 32. In the instance that the shape memory material 22 is porous, the production fluid may flow both around and through the devices. As shown in FIG. 8, upon activation, i.e., exposure to water 30 or other undesired fluids, the screen sealing devices 34 change shape and/or collapse to seal off a corresponding portion of the screen 32. The packer devices 36 change shape and/or collapse to prevent water 30 from flowing from the sealed portion to other portions of the borehole. The devices 34, 36 that have not been exposed to water 30 are not activated and thus hydrocarbon fluid can flow into the screen 32 at the unaffected portions. In the example shown in FIG. 8, the devices 34, 36 are activated to create alternate isolated zones and production zones.

Figure 9:
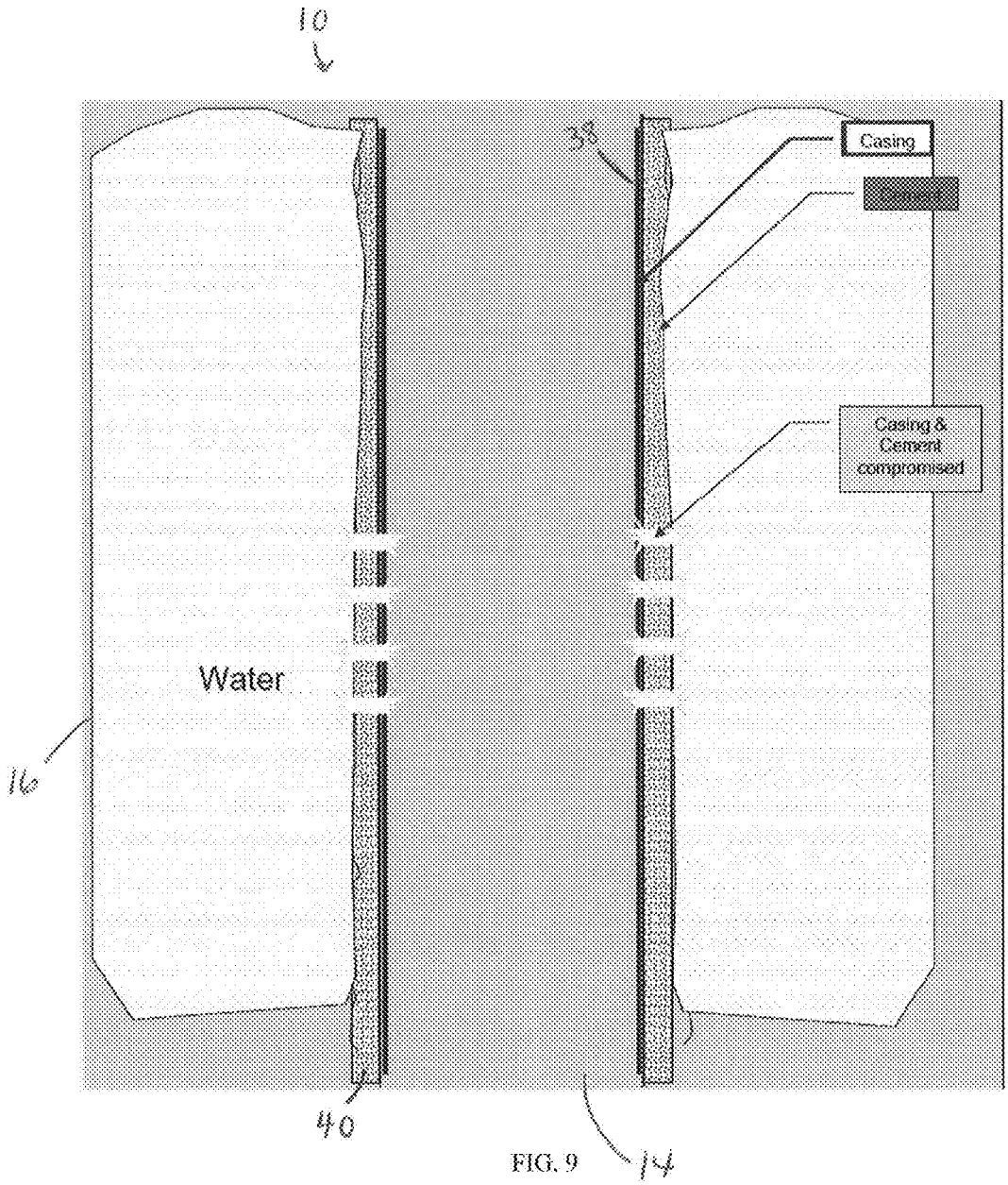
FIG. 9 is a cross-sectional view of an exemplary cased borehole.
Figure 10:
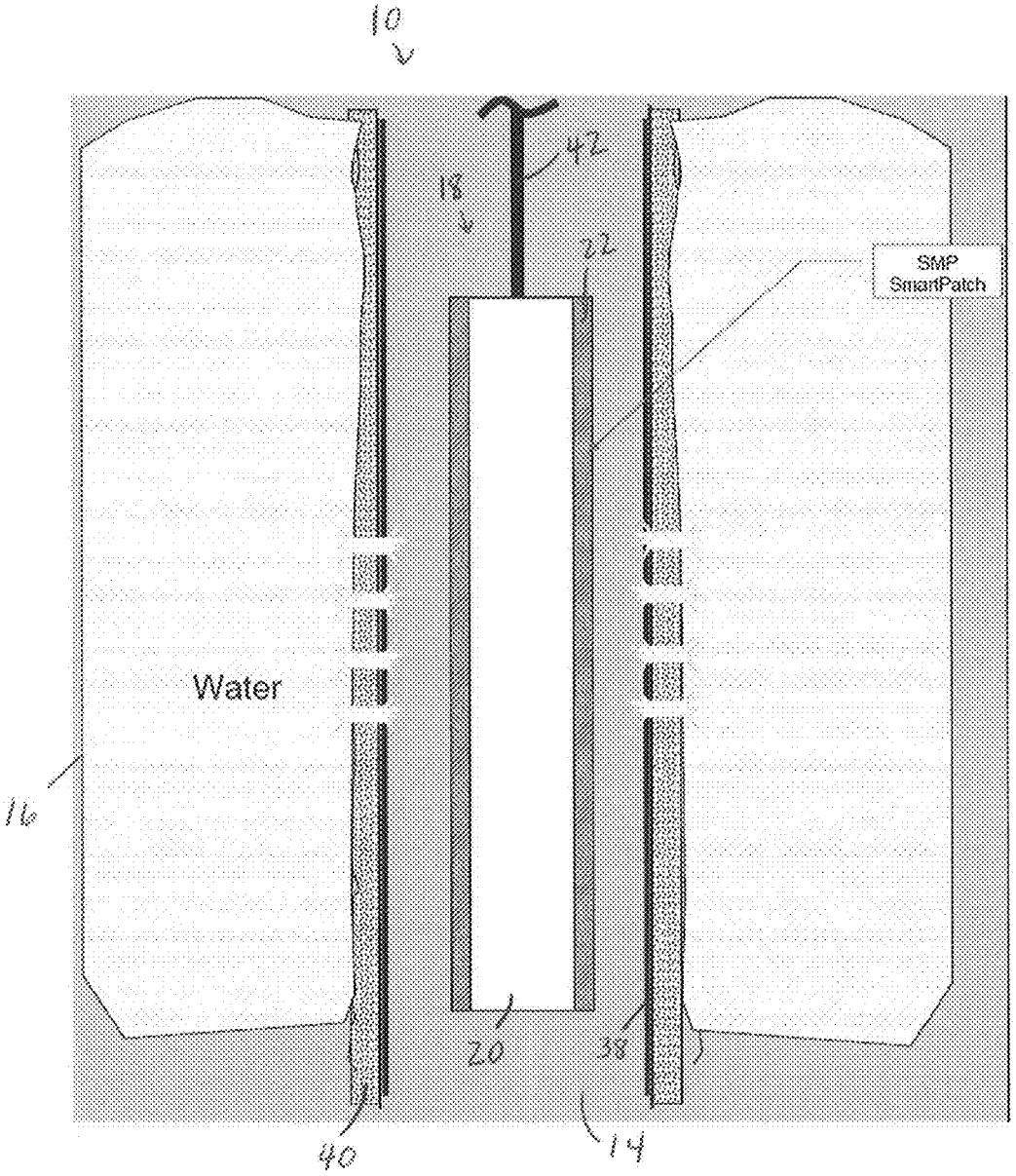
FIG. 10 is a cross-sectional view of an embodiment of a fluid flow control system deployed in the borehole of FIG. 9.
Figure 11:
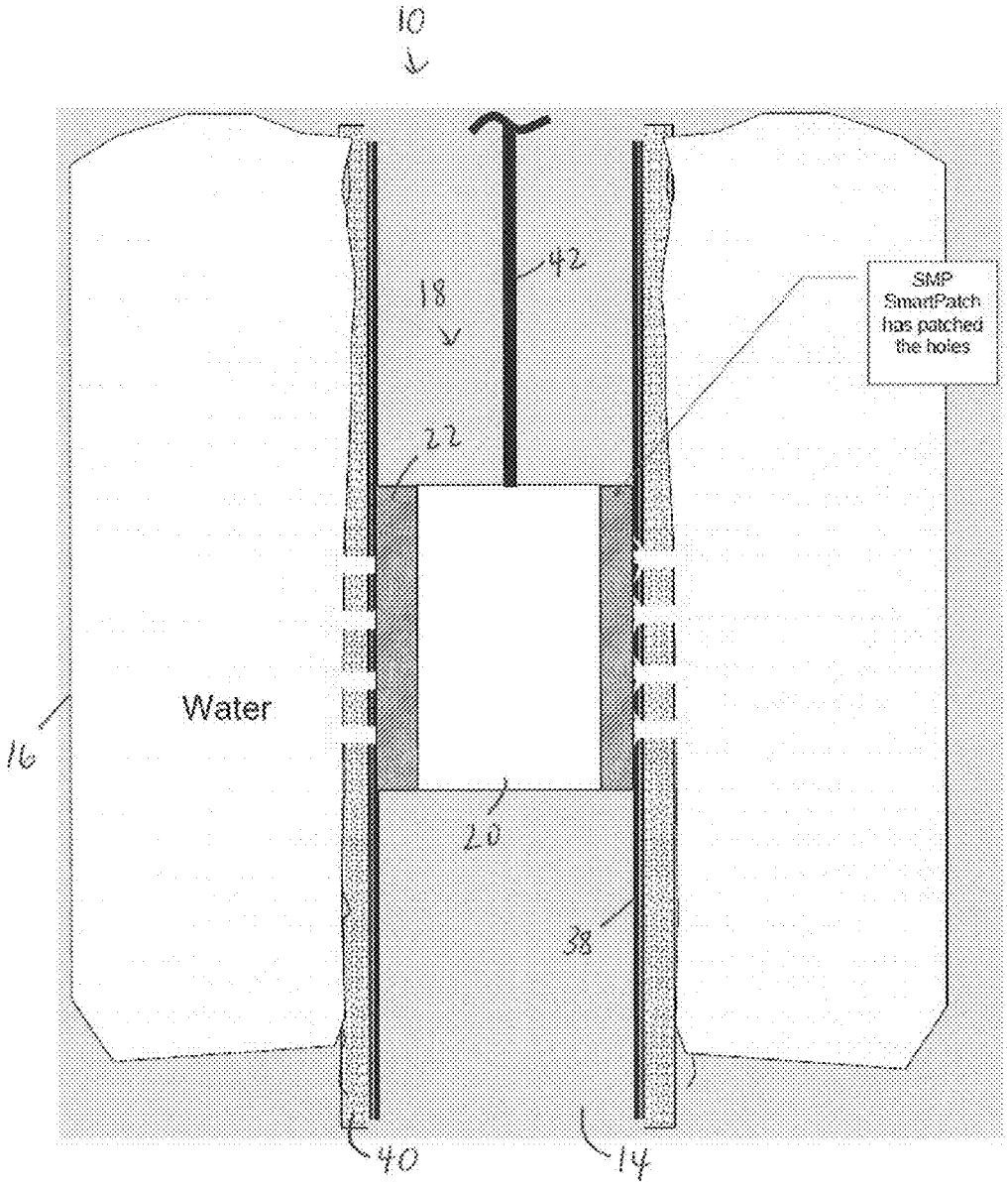
FIG. 11 is a cross-sectional view of the fluid flow control system of FIG. 10 after activation of at least one shape memory material.

FIGS. 9-11 illustrate another embodiment of the fluid flow control apparatus 18. In this embodiment, the apparatus 18 is a deployable patch configured to be lowered into the borehole 14 and positioned to prevent fluid flow through a portion of the borehole 14, such as a borehole casing 38. In this embodiment, a casing 38 is disposed in the borehole 14 and is cemented or bonded to the borehole wall via a cement 40 or other support material.

FIG. 9 illustrates an instance in which a portion of the casing 38 has been compromised, so that formation fluid is allowed to flow therethrough. The patch may be deployed in response to conditions such as compromise in the casing 38 or the borehole string 12 or for any reason to close off a fluid path or portion of the casing 38 or other downhole component. FIG. 10 illustrates the deployed patch, which is deployed by a carrier such as a wireline 42, a drillstring or other borehole string. FIG. 11 illustrates the patch after activation by a trigger, such as exposure to the formation fluid or an activation signal such as an electrical or electromagnetic signal.

The carriers described herein, such as a production string and a screen, are not limited to the specific embodiments disclosed herein. A "carrier" as described herein means any device, device component, combination of devices, media and/or member that may be used to convey, house, support or otherwise facilitate the use of another device, device component, combination of devices, media and/or member. Exemplary non-limiting carriers include borehole strings of the coiled tube type, of the jointed pipe type and any combination or portion thereof. Other carrier examples include casing pipes, wirelines, wireline sondes, slickline sondes, drop shots, downhole subs, bottom-hole assemblies, and drill strings.

Characteristics of the fluid flow control system, such as shape, configuration and deployment mechanism, are not limited to those embodiments described herein. The shape memory material may take any suitable deployment shape and, in one embodiment, deform into any desired shape upon activation. For example, the shape memory material can be made into one or more plugs to be deployed at any location of a wellbore, borehole string and/or casing string. The plugs may be deformed prior to lowering downhole into a selected temporary deployment shape to allow passage through the borehole 14 to a deployment location. The plug may be triggered by a change in fluid composition or an external trigger such as a magnetic or electrical signal to deform into its remembered shape and form a plug to prevent fluid flow therethrough. Other examples of the shape memory device shape or configuration include a plug choke and a landing collar.

Figure 12:
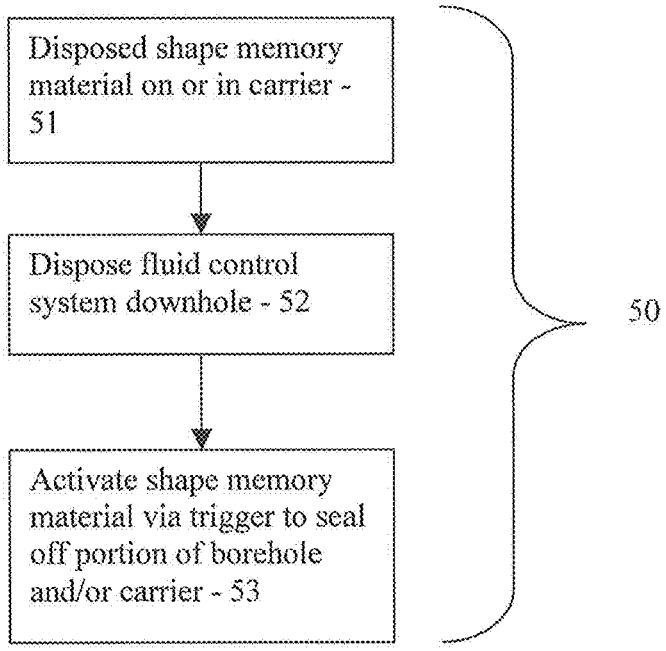
FIG. 12 is a flow diagram depicting a method of controlling fluid flow in a borehole.

FIG. 12 illustrates a method 50 of controlling fluid flow in a borehole in an earth formation. The method 50 includes one or more stages 51-53. The method 50 is described in conjunction with the fluid flow control apparatus 18 described herein, but may be used with any apparatus or system that includes shape memory material. In one embodiment, the method 50 includes the execution of all of stages 51-53 in the order described. However, certain stages may be omitted, stages may be added, or the order of the stages changed.

In the first stage 51, at fluid control apparatus 18 including least one shape memory device 20 such as a shape memory band is disposed on or in a downhole carrier, such as a borehole string 12 or wireline carrier 42. The shape memory material 22 has a first transition temperature. In one embodiment, the shape memory band is heated to a temperature at or near a transition temperature of the shape memory material 22 comprising the band, and the band is deformed to a deployment shape suitable to allow for deployment of the apparatus 18 downhole.

For example, a SMP foam or other shape memory material is molded or otherwise formed into a component having a desired shape, such as the shape of a cylindrical packer or plug. The SMP foam has a defined first Tg and Tg Onset. The SMU foam component is then heated close to the Tg of the SMP foam. A force is applied to the component to reshape it into a different configuration or shape (a temporary or deployment shape) such as a narrow band. The reshaped component is then cooled below the SMP's Tg Onset and the force removed. This deformed component will now retain the deployment shape until the temperature of the component is raised to the Tg Onset, at which point shape recovery will begin and the component will attempt to return to it's original shape or if constrained, the component will conform to a new constrained shape. In one embodiment, for a SMP having variable Tg's and Tg Onsets, the component could be reshaped as desired using the highest Tg Onset as a reshaping temperature and the lowest Tg Onset for cooling to retain the deployment shape of the component.

In the second stage 52, the fluid control apparatus 18 is deployed downhole, for example, to a region of an earth formation 16 including hydrocarbons and/or undesirable fluids such as water. Formation fluid is then produced via the borehole 14.

In the third stage 53, the shape memory band is activated by a trigger to cause the shape memory band's transition temperature to change from a first transition temperature to a second transition temperature that is approximately equal to or lower than the borehole temperature. In one embodiment, the shape memory band is activated to change to a shape configured to prevent fluid from flowing therethrough. In one embodiment, the shape memory band is made of a porous shape memory material such as a foam, and activation causes pores within the foam to collapse and prevent fluid flowing therethrough. In this manner, selected portions of the borehole 14 and/or borehole string 12 may be sealed off to prevent undesirable fluid from being produced. In one embodiment, the trigger includes the introduction of fluid including undesirable fluids to the shape memory device. The trigger may also include triggers such as changes in chemical composition of the production fluid by introduction of fluids from the formation or a user, electrical current, and electrical or magnetic fields.

The systems and methods described herein provide various advantages over existing processing methods and devices, by allowing for portions of a borehole or production apparatus to be sealed off dynamically and automatically in response to the introduction of undesired fluid in production fluid. Additional advantages include the ability to simply and effectively seal off portions by controlled signals without interrupting production or requiring retrieval of downhole components.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

The invention claimed is:

1. An apparatus for controlling fluid flow in a borehole in an earth formation, comprising:

a carrier configured to be deployed in the borehole; and a shape memory device disposed at the carrier, the shape memory device including a shape memory material having a first glass transition temperature, the shape memory material having a deployment shape formed by applying a force to a remembered shape of the shape memory material, the shape memory material having a stoichiometric ratio of an isocyanate material to a polyol material, the ratio configured to cause the shape memory material to have the first glass transition temperature and modify the first glass transition temperature to a second glass transition temperature that is lower than a borehole temperature in response to exposure of the shape memory material to a borehole fluid, and change from a glass state to a rubber state to return to the remembered shape from the deployment shape in response to the borehole temperature.

2. The apparatus of claim 1, wherein the exposure to the borehole fluid includes exposure to a change in composition of fluid in the borehole.

3. The apparatus of claim 2, wherein the change in composition includes introduction of a fluid into the borehole.

4. The apparatus of claim 3, wherein the change in fluid composition is selected from introduction of at least one of water, carbon dioxide and hydrogen sulphide into a production stream.

5. The apparatus of claim 1, wherein the shape memory material is configured to modify the first glass transition temperature based on at least one of a chemical change of the shape memory material, an electric field, a magnetic field, an electrical signal and an electromagnetic signal.

6. The apparatus of claim 1, wherein the remembered shape is selected from at least one of a borehole packer, a borehole string packer, a plug and a borehole casing patch.

7. The apparatus of claim 1, wherein the shape memory material is a shape memory polymer (SMP).

8. The apparatus of claim 1, wherein the shape memory material is a porous shape memory material including a plurality of pores.

9. The apparatus of claim 8, wherein the shape memory material is a foam.

10. The apparatus of claim 8, wherein the shape memory material is configured so that the pores collapse in response to the borehole temperature to prevent fluid flow through the shape memory material.

11. A method of controlling fluid flow in a borehole in an earth formation, comprising:

deploying a fluid flow apparatus in the borehole, the apparatus including a carrier and a shape memory device disposed at the carrier, the shape memory device including a shape memory material having a stoichiometric ratio of an isocyanate material to a polyol material, the ratio configured to cause the shape memory material to have a first glass transition temperature and modify the first glass transition temperature to a second glass transition temperature in response to exposure of the shape memory material to a borehole fluid, the shape memory material having a deployment shape formed by applying a force to a remembered shape of the shape memory material;

modifying the first glass transition temperature to the second glass transition in response to exposure of the shape memory material to a borehole fluid, the second glass transition temperature being lower than a borehole temperature; and changing the shape memory material from a glass state to a rubber state to return to the remembered shape from the deployment shape in response to the borehole temperature.

12. The method of claim 11, wherein the exposure to the borehole fluid includes exposure to a change in composition of fluid in the borehole.

13. The method of claim 12, wherein the change in composition includes introduction of a fluid into the borehole.

14. The method of claim 13, wherein the change in fluid composition is selected from introduction of at least one of water, carbon dioxide and hydrogen sulphide into a production stream.

15. The method of claim 11, wherein the shape memory material is configured to modify the first glass transition temperature based on at least one of a chemical change of the shape memory material, an electric field, a magnetic field, an electrical signal and an electromagnetic signal.

16. The method of claim 11, wherein the remembered shape is a shape of at least one of a borehole packer, a borehole string packer, a plug and a borehole casing patch.

17. The method of claim 11, wherein the shape memory material is a porous shape memory material including a plurality of pores.

18. The method of claim 17, wherein changing the shape memory material from a glass state to a rubber state includes collapsing the plurality of pores in response to the borehole temperature to prevent fluid flow through the shape memory material.

* * * * *